US012320607B2

(12) United States Patent
Homan

(10) Patent No.: US 12,320,607 B2
(45) Date of Patent: Jun. 3, 2025

(54) HANDGUN

(71) Applicant: Tim Homan, Celina, OH (US)

(72) Inventor: Tim Homan, Celina, OH (US)

(73) Assignee: STEALTH ARMS, Celina, OH (US)

( * ) Notice: Subject to any disclaimer, the term of this patent is extended or adjusted under 35 U.S.C. 154(b) by 0 days.

(21) Appl. No.: 18/533,350

(22) Filed: Dec. 8, 2023

(65) Prior Publication Data

US 2024/0219132 A1 Jul. 4, 2024

Related U.S. Application Data

(60) Provisional application No. 63/436,893, filed on Jan. 4, 2023.

(51) Int. Cl.
*F41A 3/66* (2006.01)
*F41A 9/69* (2006.01)

(52) U.S. Cl.
CPC .. *F41A 3/66* (2013.01); *F41A 9/69* (2013.01)

(58) Field of Classification Search
CPC ..... F41A 3/66; F41A 9/69
USPC ..... 42/7, 6; 89/183, 185, 194–196
See application file for complete search history.

(56) References Cited

U.S. PATENT DOCUMENTS 8,950,100 B2 * 2/2015 Nebeker ..... F41A 11/00 42/108
11,680,759 B2 * 6/2023 Bandini ..... F41A 5/02 89/196
11,686,542 B2 * 6/2023 Amir ..... F41A 3/86 89/196
11,821,703 B2 * 11/2023 Santa ..... F41A 3/12

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A pistol comprises a frame having a grip defining a magazine well and frame rails with a slide connected to the frame to reciprocate with respect to the frame between a forward battery position and a rearward recoil position. The slide defines rail passages configured to engage the frame rails, and the rail passages include upward facing elongated ledge surfaces configured to engage the frame rails with a selected overlap amount. The ledge surfaces have a plurality of different regions along their lengths with the different regions having different overlaps. The ledge surfaces may have a greater overlap at end portions, and a lesser overlap amount at an intermediate portion, with the intermediate position being proximate the magazine well, and preferably a portion of at least one of the frame rail ends remains engaged with at least one of the frame rails during motions between battery and recoil positions.

28 Claims, 6 Drawing Sheets

HANDGUN

CROSS-REFERENCE TO RELATED APPLICATIONS

This application claims the benefit of U.S. Provisional Patent Application No. 63/436,893, filed on Jan. 4, 2023, entitled "DOUBLE STACK", which is hereby incorporated by reference in its entirety for all that is taught and disclosed therein.

FIELD OF THE INVENTION

The present invention relates to semiautomatic pistols and particularly those having at least some components which are at least visually reminiscent of the Browning 1911 semiautomatic pistol.

BACKGROUND AND SUMMARY

The classic Browning 1911 single action semiautomatic pistol, along with many contemporary variants designed to be reminiscent of the original design use a slim, single stack magazine of modest capacity. In redesigning the weapon to produce a new variant having a double-stack magazine of higher capacity, several challenges arise, including that since a double-stack magazine is wider than the original 1911 single-stack design, components such as the trigger, which passes around both sides of the magazine, must be redesigned. The feed end of the magazine enters within the volume of the slide at a cutout portion of the slide to present ammunition rounds into the breech of a gun barrel retained within the slide. A wider magazine requires a bigger cutout in the vicinity where slide grooves interoperate with horizontal rails of the frame of the weapon. Inappropriately designed cutouts jeopardize the ability of the slide to remain coupled to the frame and may decrease the functional reliability of the weapon, especially if cutouts that coincide with the rail features were to align so as to allow the slide to detach from the frame at unwanted and unexpected times.

The above challenges and disadvantages are addressed by a pistol comprising a frame having a downwardly depending grip defining a magazine well and with the frame including frame rails. A slide connected to the frame is operable to reciprocate with respect to the frame between a forward battery position and a rearward recoil position. The slide defines rail passages configured to engage the frame rails. The rail passages including upward facing elongated ledge surfaces configured to engage the frame rails, and these ledge surfaces have a plurality of different regions along their lengths while the different regions also have different widths. The frame rails have lower surfaces configured to abut the rail passage ledge surfaces, which are designed so that a first set of frame rails is forward of the magazine well and a second set of frame rails is rearward of the magazine well, and especially that the first set of frame rails is immediately forward of the magazine well and the second set of frame rails is immediately rearward of the magazine well.

DETAILED DESCRIPTION OF A PREFERRED EMBODIMENT

Figure 1:
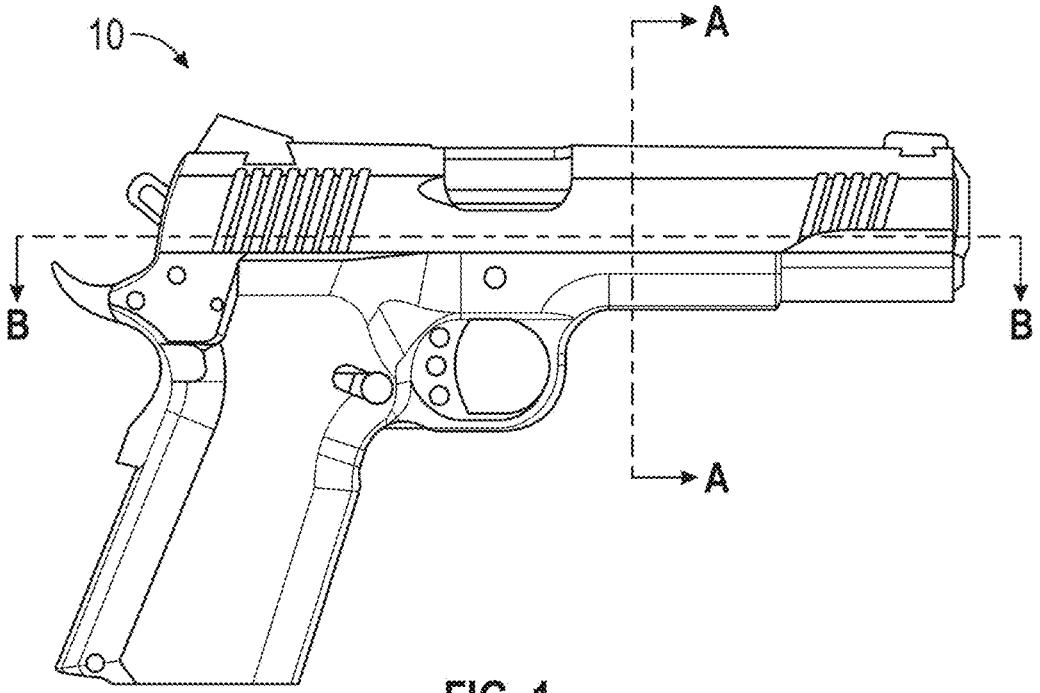
FIG. 1 shows a right side view of a handgun in accordance with the invention, defining section line A-A for FIG. 4A and its detail view 4B, and defining section line B-B for the section views of FIGS. 6A, 6B, and 6C.

The invention is a firearm having a frame with a downwardly depending grip that defines a magazine well. The frame has frame rails with a slide connected to the frame that may reciprocate with respect to the frame between a forward battery position and a rearward recoil position. The slide defines rail passages configured to engage the frame rails, and the rail passages include upward facing elongated ledge surfaces configured to engage the frame rails with a selected overlap amount. The ledge surfaces have a plurality of different regions along their lengths with the different regions having different overlaps. The ledge surfaces may have a greater overlap at end portions of the slide, and a lesser overlap amount at an intermediate portion of the slide, with the intermediate position being proximate the magazine well, and preferably a portion of at least one of the frame rail ends remains engaged with at least one of the frame rails during motions between battery and recoil positions.

The terms "handgun" and "pistol" are used interchangeably in this specification. Also in this specification locational prepositions including "ahead," "in front," and "forward" and similar pertain to directions and orientations along the barrel axis or aiming or shooting axis of the weapon and in the direction of travel of a bullet being expelled by the weapon, while "behind," "aft," "rear," and "rearward," and similar pertain to directions and orientations along the barrel axis or aiming or shooting axis of the weapon but opposite to the direction of travel of a bullet being expelled by the weapon.

In this specification the term "1911 pattern" shall be understood to refer to a semiautomatic handgun having at least ornamental similarities to the renowned "Firearm" of now U.S. Pat. No. 984,519 granted 14 Feb. 1911 to John Moses Browning, and with the inventive firearm bearing at least some visual resemblance in a side view to the side view FIG. 1 of the Browning patent, with a front view bearing at least some visual resemblance to FIG. 2 therein, with the rear view of the upper components such as the slide bearing at least some visual resemblance to FIG. 3 therein, and optionally including that external portions of some components such as the barrel bushing may bear at least some visual resemblance to FIG. 15 therein, and that portions of the slide stop may visually resemble the "breech-slide-stop" component of FIG. 21 therein. These ornamental similarities may also be limited to portions of silhouettes or perimeter contours of the views and components seen in the Browning patent. Other externally visual features of the inventive firearm may be shaped, grooved, knurled, textured, or include patterns of ridges, textures, or other features reminiscent of the Browning 1911 firearm.

The design and ornamentality of the "1911 pattern" were reproduced by many other US and foreign manufacturers including Colt, Remington-Rand, and Springfield before World War II, and in more recent decades variants were produced by High Standard, Para Ordinance, Smith and Wesson, and Kimber, and remain very popular in this era. However, ammunition feeding from double-stacked magazines is generally more reliable than from single-stack magazines because any given cartridge is not stacked directly on top of subsequent ammunition rounds as is the case in single-stacked magazines. Pistol ammunition cartridges often include a taper to the case, which allows the tip of the bullet to nosedive when loaded into single stacked magazines, especially when loading cartridges one at a time by hand. Double-stack magazines are easier and quicker to load.

AR-15-style rifles are available chambered in pistol calibers, and these commonly use double-stacked pistol magazines. The present invention, as a modified 1911 pistol, allows for magazine compatibility between firearms with an AR-15-style pistol-chambered rifled barrel. In the last 40 years, more double-stacked magazines have been produced than single-stacked. Glock, Sig Sauer, Smith & Wesson, and Ruger currently produce magazines compatible with the present invention. Mass production and availability of double-stacked magazines reduce consumer costs.

Figure 4A:
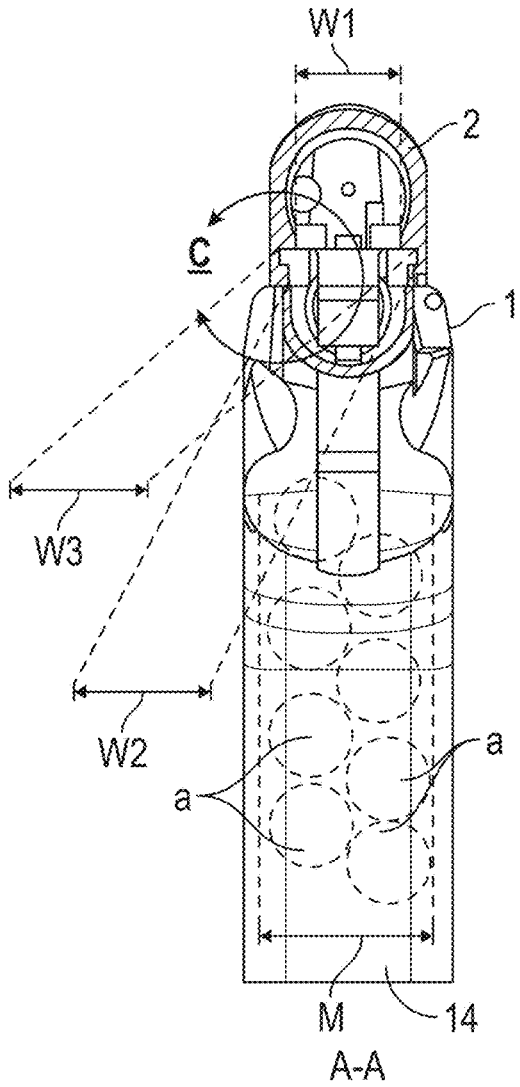
FIG. 4A shows a cross section view of the handgun of FIG. 1 taken at section line A-A defined in FIG. 1, and defining detail view "C" for the enlargement shown in FIG. 4B.
Figure 6A:
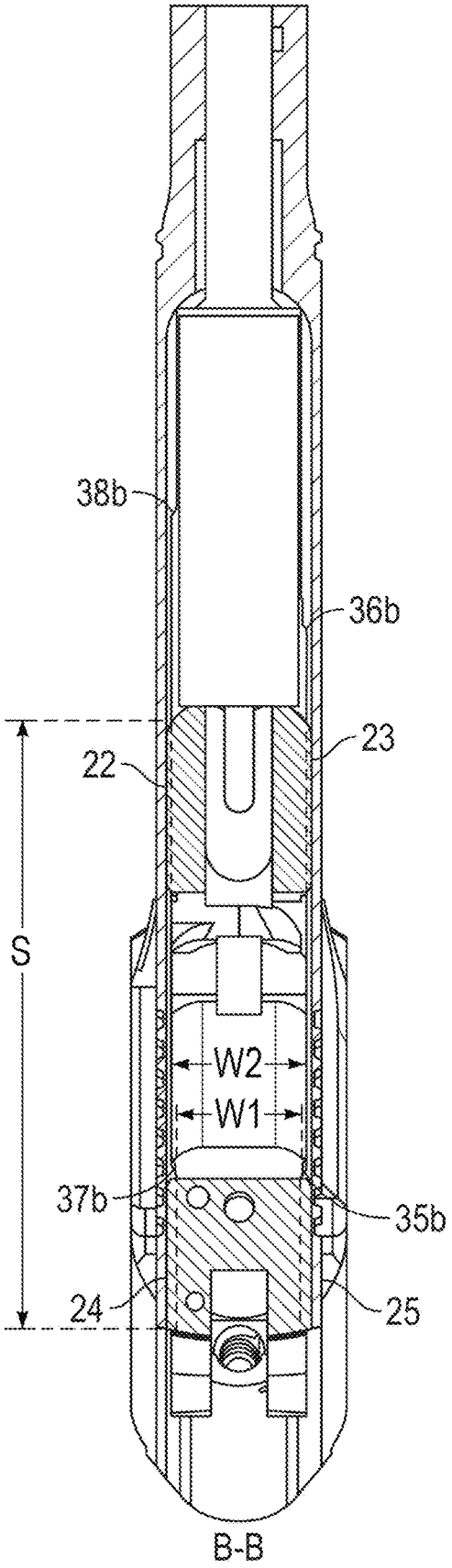
FIG. 6A shows a cross section of the handgun of FIG. 1 taken at the section line B-B defined in FIG. 1, with the firearm in a battery condition.
Figure 6B:
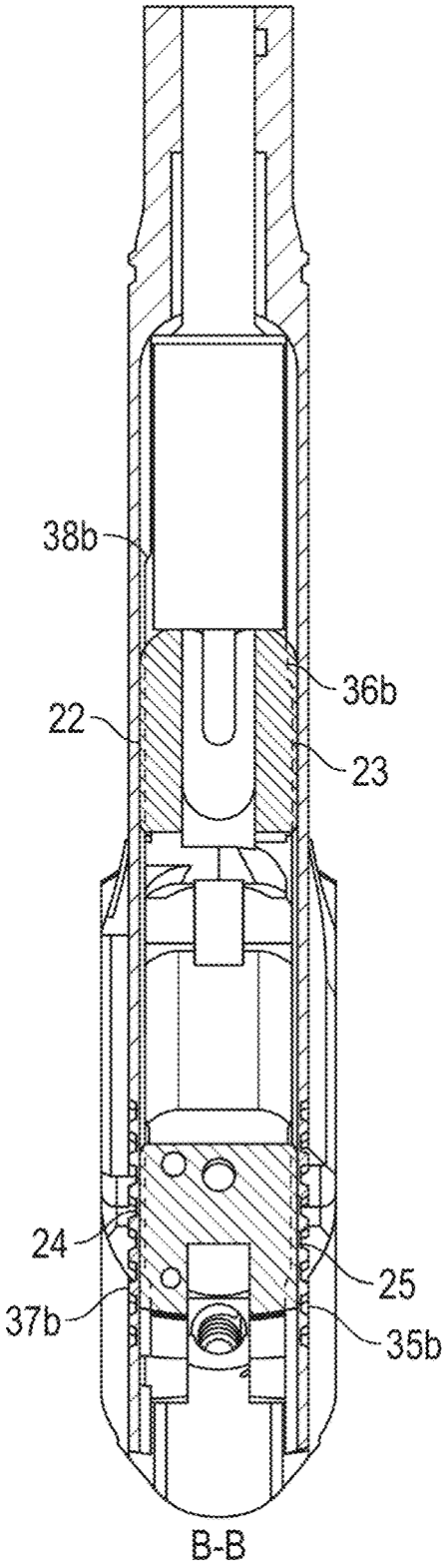
FIG. 6B shows a cross section of the handgun of FIG. 1 taken at the section line B-B defined in FIG. 1, with the firearm in a condition partially recoiled from a battery condition.
Figure 6C:
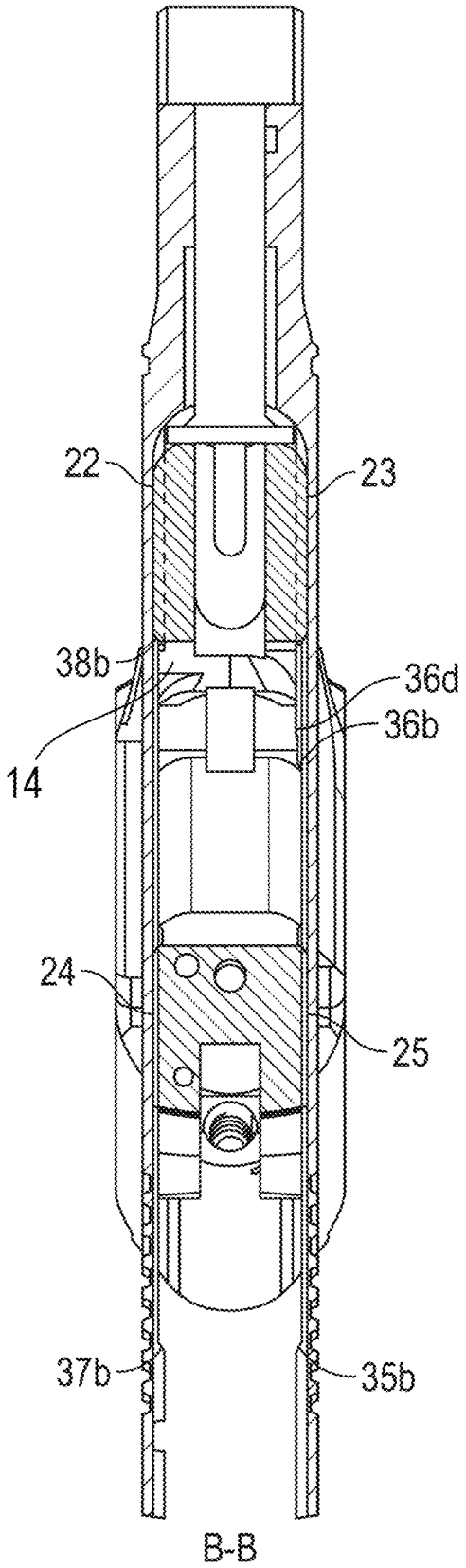
FIG. 6C shows a cross section of the handgun of FIG. 1 taken at the section line B-B defined in FIG. 1, with the firearm in a fully recoiled condition, such as with the slide locked back for inspection or after expending all rounds from its magazine.

Referring now to the figures, FIG. 1 shows a right side view of a handgun in accordance with the invention, defining section line A-A for FIG. 4A and its detail view 4B, and defining section line B-B for the section views of FIGS. 6A, 6B, and 6C. The "1911 pattern" of the inventive handgun is clearly appreciated in this view.

Figure 2:
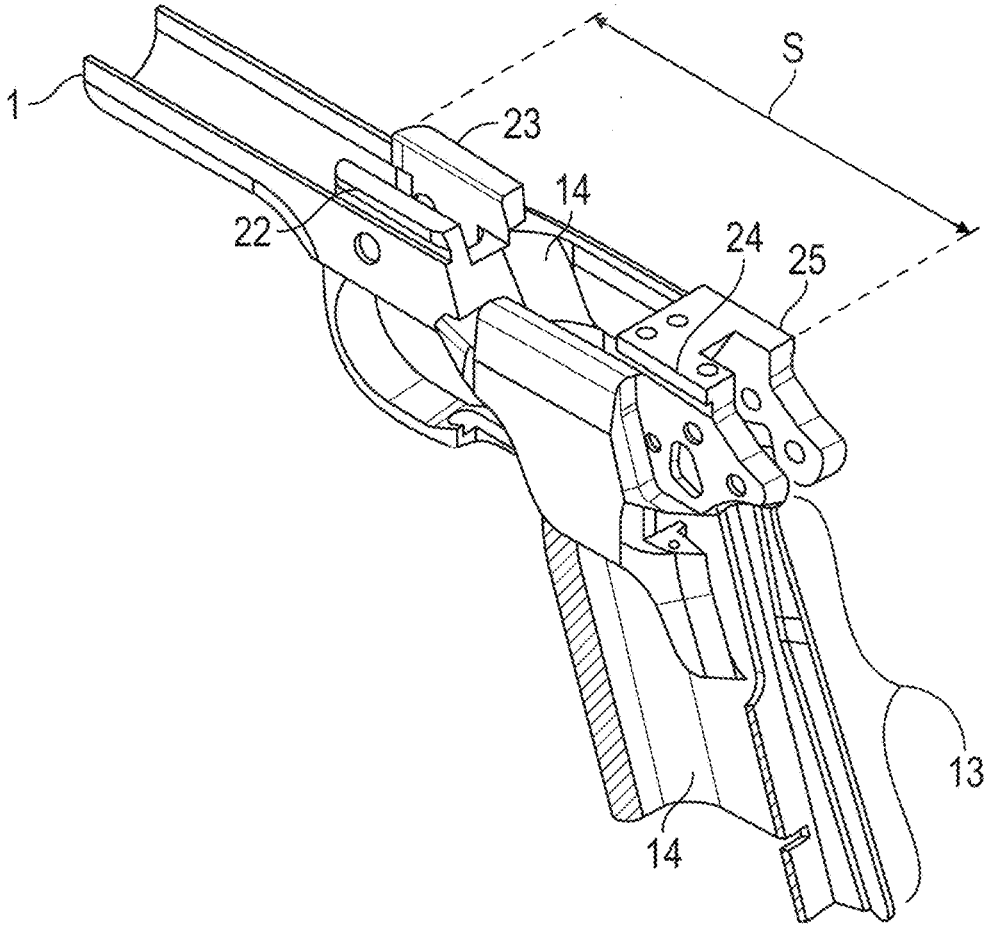
FIG. 2 shows an oblique, left top rear view of the frame of the handgun of FIG. 1.

FIG. 2 shows an oblique, left top rear view of the frame [1] of the handgun of FIG. 1. The downwardly depending grip portion of the frame is shown partially cut away to a midplane indicated by the shaded surfaces. The grip defines a magazine well for receiving a double-stack magazine wider than the slim, single-stack magazine of the original Browning prototype. The frame includes two elevated platforms proximate to and directly ahead of and behind the upper end of the magazine well. The platforms are spaced apart by a distance related to the horizontal length of a cross section of the magazine at its emergence from the magazine well, and when installed the upper end of the magazine resides between the platforms. The forward platform is bifurcated to clear the barrel as held by the slide, and includes a first set of frame rails and forward of the magazine well. The rear platform includes a second set of frame rails and rearward of the magazine well. In preferable embodiments the first set of frame rails is immediately forward of the magazine well and the second set of frame rails is immediately rearward of the magazine well. An engagement distance [S] of the frame to the slide may be defined as extending from the rearmost edge of the rear platform, across the magazine well opening, and extending to the frontmost edge of the forward platform. An exemplary value for the horizontal dimension [S] may between about 3.2 inches and about 4.0 inches. The frame rails are divided into two sections to allow for the additional clearance required by double-stacked magazines. The widths of the frame rails are also increased to accommodate for the required changes to the slide. The frame remains as narrow as is practicable to aid concealability.

Figure 3A:
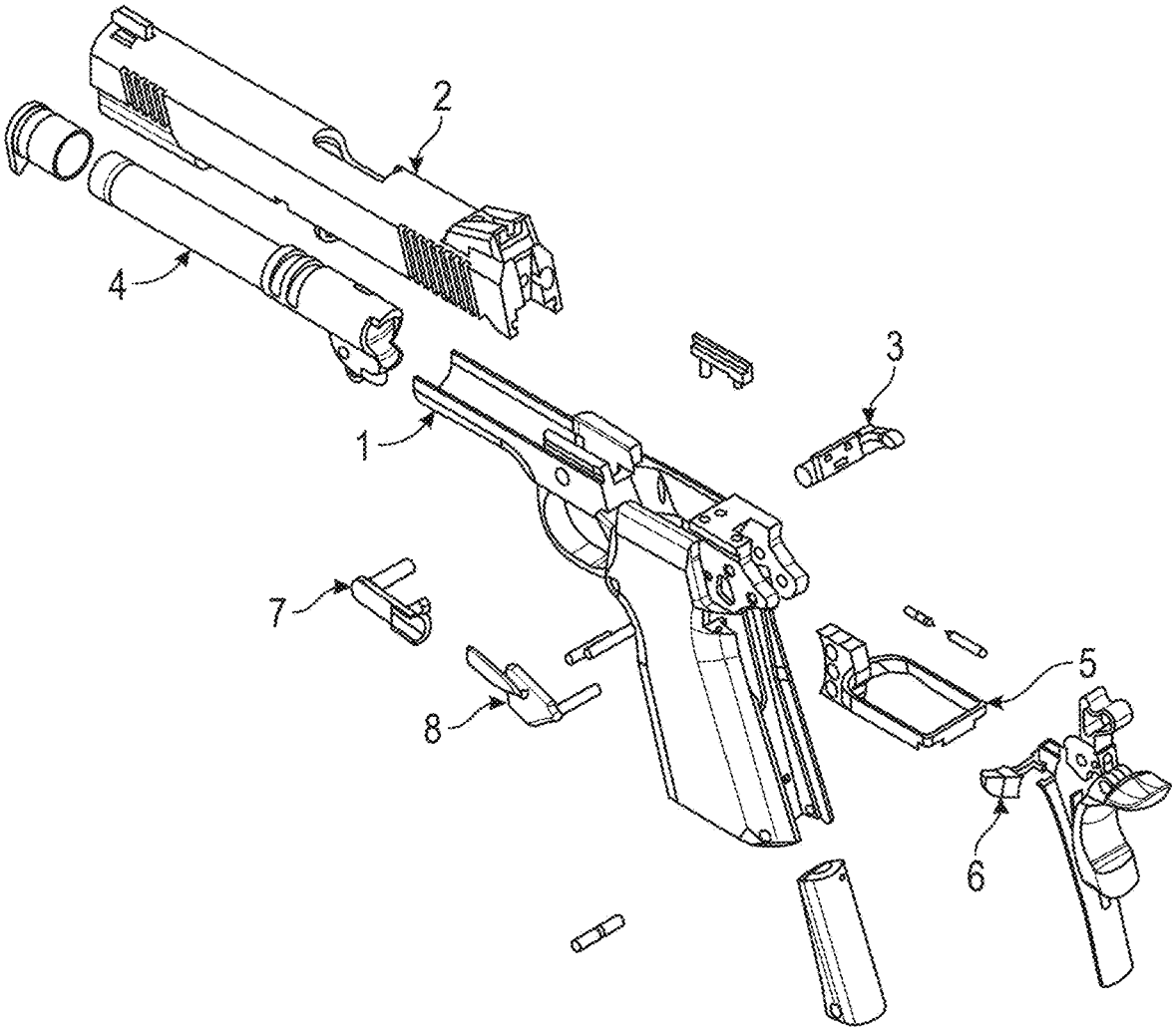
FIG. 3A shows an oblique, left top rear exploded view of components of the handgun of FIG. 1.

FIG. 3A shows an oblique, left top rear exploded view of components of the handgun of FIG. 1. The barrel [4] is secured within the slide [2] with the muzzle end of the barrel positioned with respect to the slide by a bushing. The accuracy of the pistol depends on the machining accuracy of the barrel muzzle within this bushing and in turn the accuracy of fit of the bushing within the distal end of the slide.

Compared with the original 1911, the inventive design includes modifications to various components to accommodate a double-stack magazine. The frame area inside the grip has increased width to accommodate wider double-stacked magazines. The magazine well includes a magazine stop towards the top of the frame that blocks magazines from being inserted too high in the frame. Many modern variants have retained the original 1911's physically exposed plunger tube, which may loosen over time. The plunger in the disclosed design is embedded within the frame to prevent interference with the magazine. The plunger at its forward end seats in a small detent on the slide stop [7] to keep the slide stop from interfering with slide operation. The plunger at its rear end is responsible for keeping the thumb safety [8] in either the safe (up position) or fire (down position,) using a similar but more pronounced detent than the original slide stop so that compared to an original 1911, the user may feel a more positive difference clicking between safe and fire conditions.

Compared to the original 1911, the magazine catch [3] of the inventive pistol disclosed herein has an increased overall length to supply clearance around double-stacked magazines. In an original 1911 design, a transverse length dimension of a cylindrical surface of the original catch is 0.696 inches long, while in a preferred embodiment of the inventive design disclosed herein, the length of a comparable transverse cylindrical surface is about 1.096 inches. A step length of the magazine catch step lengthened from 0.479 inches in the original 1911 design to about 0.574 inches to permit this portion of the component to wrap around the frontal magazine radius and hold the magazine in position.

The trigger [5] of the original 1911 bifurcates into a stirrup shaped portion and the arcuate portion forward of the stirrup is called the trigger bow. The trigger insert [6] plugs into and closes a gap at the rear of the frame. This gap is not present in single-stack 1911 frames. The wider trigger bow of the inventive embodiment shown in this figure requires a gap for installing the trigger into the frame. The trigger inserts are held in place by seating within two transverse pockets in the frame.

Figure 3B:
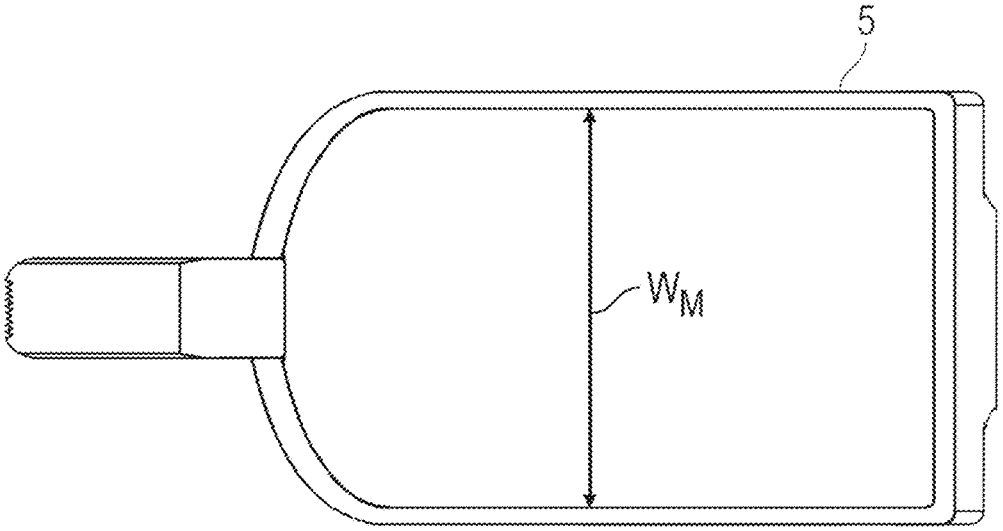
FIG. 3B shows a top view of a trigger component of the handgun of FIG. 1, also defining an inner clearance width dimension.

FIG. 3B shows a top view of a trigger component [5] of the handgun of FIG. 1, and defines an inner clearance width dimension [WM] also called a trigger bow magazine clearance. The width of this clearance is increased to allow double-stacked magazines, such as one of width [M] shown in dashed lines in FIG. 4*a*, to fit between the trigger bow without interfering with the trigger function. The bow width of the exemplary embodiment shown changes is increased to about 1.083 inches in comparison to 0.624 inches of the original 1911 pattern, while the 0.033 inch wall thickness remains the same. A clearance cut is also made to the bow to create space around the magazine catch so that it does not interfere with trigger movement. The trigger may be machined from a solid piece of aluminum, steel, or plastic.

Figure 4B:
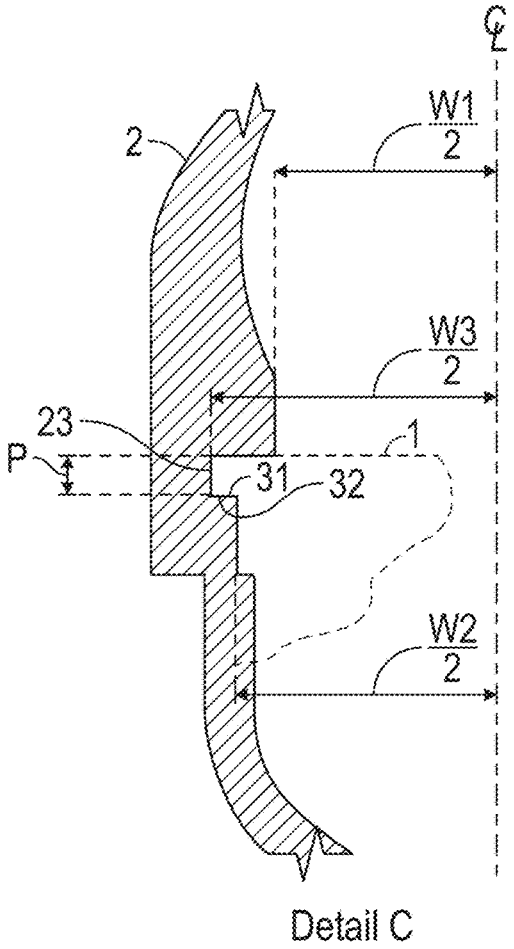
FIG. 4B shows an enlargement of a detail section of the handgun of FIG. 1 as defined by detail view "C" shown in FIG. 4A.

FIG. 4A shows a cross section view of the handgun of FIG. 1 taken at section line A-A defined in FIG. 1, and defining detail view "C" for the enlargement shown in FIG. 4B. The frame [1] includes laterally outwardly projecting rails which interdigitate with inward facing grooves in the slide [2.] As seen in this figure and also in the enlargement FIG. 4B, the lateral width [W1] of the slide material above its groove for the frame rails is narrower than the width [W3] of the frame rails, and the lateral width [W2] of the slide material below its groove for the frame rails is narrower than the width [W3] of the frame rails. The material defining width [W3] is cut away along portions of its length to create a slot wide enough to admit the upper end of a double-stack magazine of width [M] installed in the magazine well of the grip portion of the frame. This cross section illustrates a portion of an installed magazine and some cartridges contained therein in dashed lines. Under the influence of the magazine spring and follower, the sequence of ammunition cartridges [a] arrange themselves in a zig-zag firing order.

FIG. 4B shows an enlargement of a detail section of the handgun of FIG. 1 as defined by detail view "C" shown in FIG. 4A. A portion of the frame [1] is illustrated in broken line. The slide [2] is connected to the frame by means of the slide defining rail passages [P] configured to engage the frame rails. The rail passages include upward facing elongated ledge surfaces configured to engage the frame rails such as shown here. The frame rails have lower surfaces configured to abut the rail passage ledge surfaces. The slide is thus operable to reciprocate with respect to the frame between a forward battery position and a rearward recoil position which will be shown in FIGS. 6A and 6C respectively. Since widths [W1,] [W2,] and [W3] of FIG. 4A refer to features which are symmetrical about the slide centerline [℄,] they are represented as half-value dimensions [W1/2,] [W2/2,] and [W3/2] from the referenced features to the centerline.

Figure 5A:
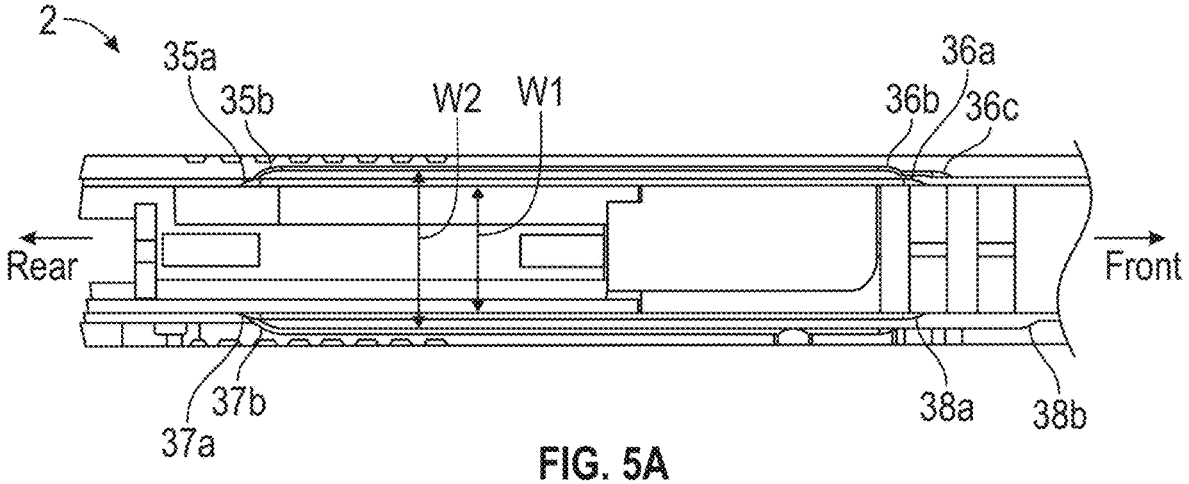
FIG. 5A shows a bottom view of a slide component of the handgun of FIG. 1.

FIG. 5A shows a bottom view of a slide component [2] of the handgun of FIG. 1, with the ledge surfaces of the rail passages of the slide having a plurality of different regions along their lengths, and the different regions having different widths. In the exemplary embodiment shown in this figure, the ledge surfaces define a spacing therebetween, i.e, between associated left-side and right-side features, and the width spacing is greater at an intermediate location along the length of the ledge surfaces than a spacing of lesser width at at least one of a forward location forward of the intermediate location and a rear location rearward of the intermediate location. The spacing is greater at the intermediate location than at either of the forward location or the rear location. The spacing at the intermediate location is at least as great as a width of the magazine well. The length of these regions of wider spacings is at least as long as the sum of a first, horizontal length of a cross section of the magazine at its admittance into the volume of the slide, plus a second length which is the length of excursion of the slide between its battery position and a fully recoiled position.

Referring to the particular embodiment illustrated in this figure, the ledge surfaces define a spacing [W1] between associated left-side and right-side features of material of the above the lateral rails of the frame and the rail passages of the slide which receive the frame rails. To admit a modern double-stack magazine, which wider than the single stack or "stick" magazine for which the original 1911 slide was designed, slide material below the rail passages and along the length of excursion of the slide over the double-stack magazine is cut away, leaving a width spacing [W2] greater than [W1] at an intermediate location along the length of the ledge surfaces from a rear end of the right-side cutout [35*b*] and extending along the right side to a forward end of the cutout at [36*c*.] The cutouts to the slide are preferably finished at their ends with fillets or chamfers. In this particular embodiment, the front end of the cutout beneath the right side rail passage of the slide begins with a fillet at [35*b*] and ends with a first fillet [36*b*] to an intermediate width between [W2] and [W1,] and a second fillet [36*c*] at the forward end of the cutout. The related cutout beneath the left side rail passage of the slide begins with a fillet at [37*b*] directly athwart the fillet [35*b*] beneath the right side rail passage, and continues past the forward end fillets of the cutout beneath the right side rail passage to terminate with a fillet or chamfer at [38*b*.] Thus, the left side cutout beneath the left side rail passage is longer than the right side cutout beneath the right side rail passage. The spacing [W2] is greater at the intermediate location than at either of the forward location and the rear location, where the spacing is [W1.] Specifically in the embodiment illustrated here, the spacing [W2] is greater at an intermediate location along the length of the ledge surfaces (such as a location between [35*b*] and [36*b*]) than a lesser spacing [W1] at at least one forward location (such as any of [36*a*,] [36*b*,] [36*c*,] [38*a*,] or [38*b*]) forward of the intermediate location and a rear location rearward of the intermediate location (such as [35*b*] or [37*b*.]) The spacing [W2] at the intermediate location is at least as great as a width of the magazine well. Also, the spacing at at least one forward location forward of the intermediate location (such as any of [36*a*,] [36*b*,] [36*c*,] [38*a*,] or [38*b*]) and a rear location rearward of the intermediate location (such as [35*b*] or [37*b*]) is narrower than a width of the magazine well, wherein the magazine well is configured with a width to accept a double stack magazine.

Additional cutouts are made in the slide material above the rail passages and along the length of excursion of the slide over the double-stack magazine. In the embodiment shown, the upper edges of the medial limits of the rail passages of the slide are rounded or filleted along lengths related to the horizontal length which is the sum of a cross section of the magazine at its admittance into the volume of the slide, plus the length of excursion of the slide between its battery position and a fully recoiled position. The upper edge of the medial limit of the right side rail passage of the slide is rounded or filleted from a rear location [35*a*] to a forward location [36*a*,] and the upper edge of the medial limit of the left side rail passage of the slide is rounded or filleted from a rear location [37*a*] to a forward location [38*a*.]

Figure 5B:
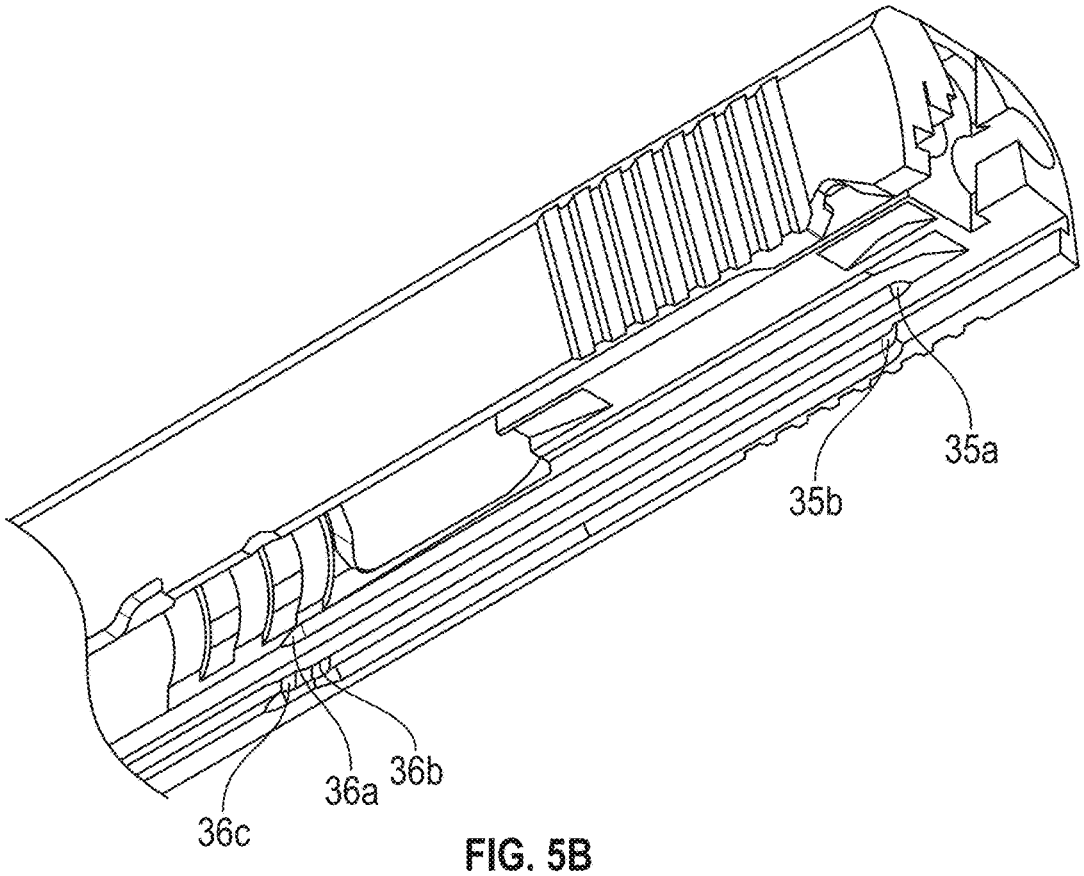
FIG. 5B shows an oblique, left bottom rear view of a rear portion of the slide component shown in FIG. 5A.

FIG. 5B shows an oblique, left bottom rear view of a rear portion of the slide component shown in FIG. 5A. Here it is seen that the upper edge of the medial limit of the right side rail passage of the slide is rounded or filleted from a rear location [35*a*] to a forward location [36*a*,] and slide material below the right side rail passage is also cut away, beginning with a filleted entry into the cutout at [35*b*,] proceeding along the length of the slide to a first fillet [36*b*] to an intermediate cutout depth, and a second fillet [36*c*] finishing the forward end of the cutout. An exemplary value for the horizontal length between [35*b*] and [36*c*] may between about 3.00 inches and about 3.75 inches.

Figure 5C:
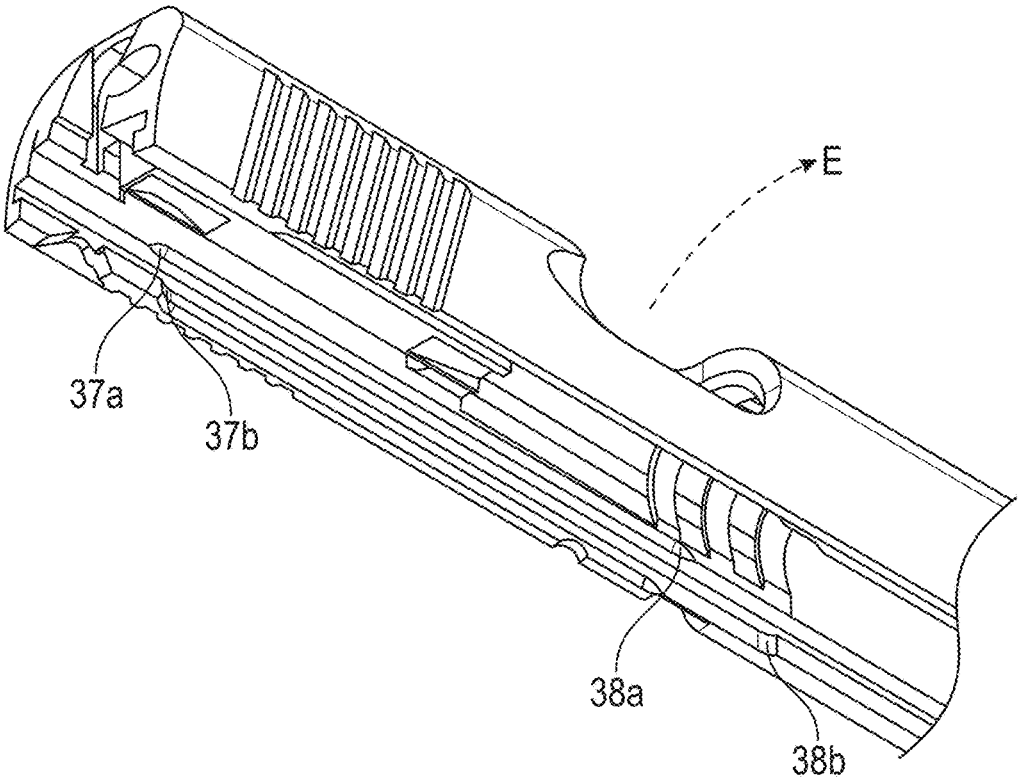
FIG. 5C shows an oblique, right bottom rear view of the rear portion of the slide component shown in FIG. 5A.

FIG. 5C shows an oblique, right bottom rear view of the rear portion of the exemplary slide component shown in FIG. 5A. Here it is seen that the upper edge of the medial limit of the left side rail passage of the slide is rounded or filleted from a rear location [37*a*] to a forward location [38*a*,] and slide material below the right side rail passage is also cut away, beginning with a filleted entry into the cutout at [37*b*,] proceeding along the length of the slide to finish with a fillet at [38*b*] at a location further forward along the slide than location [38*a*.] An exemplary value for the horizontal length between [37*b*] and [38*b*] may between about 3.21 inches and about 4.26 inches. In preferable embodiments, the lengths for the chamfers [37*b*] to [38*a*] should be the same length as chamfers [35*a*] to [36*a*] seen in FIG. 5B, and exemplary values for the lengths for these chamfers may be between about 3.10 inches to about 3.85 inches. The exemplary slide shown is configured for right side ejection of spent cartridge cases along an ejection path [E.] Symmetrical variants of all components disclosed herein so as to produce a pistol with left side ejection of spent cartridges also remain within the scope of the invention and the claims.

FIG. 6A shows a cross section of the handgun of FIG. 1 taken at the section line B-B defined in FIG. 1, with the firearm in a battery condition. The forward platform of the frame seen in FIG. 2 includes frame rails and forward of the magazine well. The rear platform includes frame rails and rearward of the magazine well. The lateral widths of the frame rails closely approximate the lateral width [W3] of the rail cutout in the slide as also seen in FIGS. 4A and 4B. The rail passages of the slide, also seen in FIGS. 4A and 4B, include upward facing elongated ledge surfaces configured to engage the frame rails with a selected overlap amount seen in this figure.

The ledge surfaces have a plurality of different regions along their lengths, with the different regions having different overlap amounts. The ledge surfaces have a greater overlap amount at end portions, and a lesser overlap amount at an intermediate portion. In the exemplary embodiment shown, a first overlap of [W3] being greater than [W1] exists at the rear end portion of the slide which when in battery engages with the entire horizontal lengths of the ledges and of the second platform of the slide closely aft of the magazine well [14.] The overlap [W3] being greater than [W1] also occurs at the forward end of the slide by the muzzle, such as forward of the ends of the slide rail cutouts [38*b*] and [36*b*.] In the intermediate position between the rear beginning of the left side cutout [37*b*] and the forward end of that cutout [38*b*,] and also between the rear beginning of the right side cutout [35*b*] and the forward end of that cutout [36*b*,] a second overlap of [W3] being greater than [W2] exists. This intermediate location is proximate the magazine well, and has a rear limit at [35*b*] and [37*b*] registered with a rear limit of the magazine well when the slide is in the battery position as shown in this figure.

The frame rails of the forward platform have a forward end, and the frames rail rear of the magazine well and have a rear end, with the distance between the forward end of the forward frame rail and the rear end of the rear frame rail defining a frame rail system overall length [S.] In this figure it is seen that the length of at least one of the intermediate portions where the frame rail ledge surfaces have been cut has a lesser length than the frame rail system overall length. The horizontal distance from [35*b*] to [36*b*] is less than length [S.]

FIG. 6B shows a cross section of the handgun of FIG. 1 taken at the section line B-B defined in FIG. 1, with the firearm in a condition partially recoiled from a battery condition. The reference numerals in this figure correspond to the reference numerals defined in FIG. 6A. At least a portion of the frame rails reside in a portion of the slide having the greater overlap [W3] minus [W1] as seen in FIG. 6A.

FIG. 6C shows a cross section of the handgun of FIG. 1 taken at the section line B-B defined in FIG. 1, with the firearm in a fully recoiled condition, such as with the slide locked back for inspection or after expending all rounds from its magazine. The reference numerals in this figure correspond to the reference numerals defined in FIG. 6A. An intermediate position of lesser overlap of the frame rails within the rail passages of the slide begins at the rear of the left side cutout [37*b*] and extends to the forward end of that cutout [38*b*.] It is seen that this intermediate location of lesser overlap has its forward limit (at [38*b*]) registered with a forward limit of the magazine well when the slide is in the recoil position. However, in this condition the entirety of the forward platform with its frame rails and engage with the slide rail passages at a region of greater overlap.

Reviewing FIGS. 6A, 6B, and 6C together, it will be appreciated that at all points along the operating range of the slide between the battery condition, with or without a cartridge loaded in the barrel chamber, and a recoil position or a slide position when locked open by the slide stop for inspection, at least a portion of at least one of the end portions of the rail passages of the slide remains in engagement with at least one of the frame rails throughout a range of motion between the battery and recoil positions. The slide is connected to the frame and operable to reciprocate with respect to the frame between a forward battery position and a rearward recoil position, and it is also seen in these three figures that over the entire horizontal range of motion of the slide with respect to the frame, at least one region of greater overlap of the ledges of the slide rail passages engages with the slide rails at either the forward or the rear slide rail platform of the frame.

In continuing to compare the inventive handgun disclosed herein with the original "1911 pattern," the slide is changed from a standard 1911 slide to allow for double-stack magazine clearance, such as magazines made for Glock pistols. The double-stack magazines would otherwise interfere with the slide without these changes. The slide rails are cut deeper to about 0.814 inches from the 0.754 inch depth of the original 1911, to allow for proper engagement with the frame rails. This allows for 0.030 inch deep relief cuts and chamfers to be added to each side of the slide so that double-stack magazines may be seated high enough into the frame for proper ammunition feeding.

The barrel feed ramp is changed to have a larger radius than the original 1911 at the transition of the chamber from the feed ramp. A clearance cut is added under the feed ramp to allow space for double-stacked magazines to move high enough into the frame. The main body of the thumb safety is shortened at the bottom to accommodate the addition of the trigger insert. The overall length is decreased to about 0.668 inches from the 0.700 inches of the original 1911. The hook, which measures about 0.039 inches, is added to allow the newly designed thumb safety to work with standard 1911 plunger tubes as well as the integrated plunger tube discussed in FIG. 3A. The slide stop magazine nub, which has a length of about 0.200 inches, is redesigned to give clearance around the magazine, slide, and frame while maintaining magazine follower contact to lock the slide rearward after the last ammunition round in a magazine is expended.

The present disclosure is to be limited only by the terms of the appended claims, along with the full scope of equivalents to which such claims are entitled. Many modifications and variations may be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims.

I claim:

1. A pistol comprising:

a frame having a downwardly depending grip defining a magazine well;

the frame including frame rails;

a slide connected to the frame and operable to reciprocate with respect to the frame between a forward battery position and a rearward recoil position;

the slide defining rail passages configured to engage the frame rails;

the rail passages including upward facing elongated ledge surfaces configured to engage the frame rails;

the ledge surfaces having a plurality of different regions along their lengths and the different regions having different widths.

2. The pistol of claim 1, wherein the frame rails have lower surfaces configured to abut the rail passage ledge surfaces.

3. The pistol of claim 1, wherein a first set of frame rails is forward of the magazine well and a second set of frame rails is rearward of the magazine well.

4. The pistol of claim 1, wherein a first set of frame rails is immediately forward of the magazine well and a second set of frame rails is immediately rearward of the magazine well.

5. The pistol of claim 1, wherein the ledge surfaces define a spacing therebetween, and the spacing is greater at an intermediate location along the length of the ledge surfaces than a lesser spacing at at least one of a forward location forward of the intermediate location and a rear location rearward of the intermediate location.

6. The pistol of claim 5, wherein the spacing is greater at the intermediate location than at either of the forward location and the rear location.

7. The pistol of claim 5, wherein the spacing at the intermediate location is at least as great as a width of the magazine well.

8. The pistol of claim 5, wherein the spacing at the at least one of a forward location forward of the intermediate location and a rear location rearward of the intermediate location is narrower than a width of the magazine well.

9. The pistol of claim 5, wherein the intermediate location has a forward limit registered with a forward limit of the magazine well when the slide is in the recoil position and the intermediate location has a rear limit registered with a rear limit of the magazine well when the slide is in the battery position.

10. The pistol of claim 1, wherein the magazine well is configured with a width to accept a double stack magazine.

11. The pistol of claim 1, wherein the pistol is a 1911 pattern.

12. A pistol comprising:

a frame having a downwardly depending grip defining a magazine well;

the frame including frame rails;

a slide connected to the frame and operable to reciprocate with respect to the frame between a forward battery position and a rearward recoil position;

the slide defining rail passages configured to engage the frame rails;

the rail passages including upward facing elongated ledge surfaces configured to engage the frame rails with a selected overlap amount;

the ledge surfaces having a plurality of different regions along their lengths, the different regions having different overlap amounts.

13. The pistol of claim 12, wherein the ledge surfaces have a greater overlap amount at end portions, and a lesser overlap amount at an intermediate portion.

14. The pistol of claim 13, wherein the intermediate position is proximate the magazine well.

15. The pistol of claim 13, wherein the frame rails include a forward frame rail forward of the magazine well and having a forward end, and a rear frame rail rear of the magazine well and having a rear end, the distance between the forward end of the forward frame rail and the rear end of the rear frame rail being a frame rail system overall length, and wherein the intermediate portion of the ledge surfaces has a lesser length than the frame rail system overall length.

16. The pistol of claim 13, wherein at least a portion of at least one of the end portions remains in engagement with at least one of the frame rails throughout a range of motion between the battery and recoil positions.

17. The pistol of claim 13, wherein the frame rails include a forward frame rail forward of the magazine well and having a forward end, and a rear frame rail rear of the magazine well and having a rear end, the distance between the forward end of the forward frame rail and the rear end of the rear frame rail being a frame rail system overall length, and wherein the intermediate portion of the ledge surfaces has a lesser length that the frame rail system overall length.

18. The pistol of claim 13, wherein the at least a portion of at least one of the end portions remains in engagement with at least one of the frame rails throughout a range of motion between the battery and recoil positions.

19. The pistol of claim 13, wherein the frame rails include a forward frame rail forward of the magazine well and having a forward end, and a rear frame rail rear of the magazine well and having a rear end, the distance between the forward end of the forward frame rail and the rear end of the rear frame rail being a frame rail system overall length, and wherein the intermediate portion of the ledge surfaces has a lesser length that the frame rail system overall length.

20. The pistol of claim 13, wherein the at least a portion of at least one of the end portions remains in engagement with at least one of the frame rails throughout a range of motion between the battery and recoil positions.

21. The pistol of claim 1, wherein the regions along the length of the ledge surfaces having different widths are elongated surfaces.

22. The pistol of claim 1, wherein the ledge surfaces include a first forward elongated rail portion having a first ledge surface with a first width;

a second intermediate elongated rail portion rearward of the first forward elongated rail portion having a second ledge surface a second width less than the first width; and a third rear elongated rail portion rearward of the second intermediate elongated rail portion having a third ledge surface with a third width greater than the second width.

23. The pistol of claim 22, wherein the second intermediate portion extends forward and rearward of the magazine well.

24. The pistol of claim 22, wherein the second intermediate portion extends forward and rearward of the ejection port.

25. The pistol of claim 12, wherein the regions along the length of the ledge surfaces having different overlap amounts are elongated surfaces.

26. The pistol of claim 12, wherein the ledge surfaces include a first forward elongated rail portion having a first ledge surface with a first overlap amount;

a second intermediate elongated rail portion rearward of the first forward elongated rail portion having a second ledge surface a second overlap amount less than the first overlap amount; and a third rear elongated rail portion rearward of the second intermediate elongated rail portion having a third ledge surface with a third overlap amount greater than the second overlap amount.

27. The pistol of claim 26, wherein the second intermediate portion extends forward and rearward of the magazine well.

28. The pistol of claim 26, wherein the second intermediate portion extends forward and rearward of the ejection port.

* * * * *